US005405053A

United States Patent [19]

Zublin

[11] Patent Number: 5,405,053

[45] Date of Patent: Apr. 11, 1995

[54] BULK BAG OPENER AND DISPENSER

[75] Inventor: Casper W. Zublin, Bakersfield, Calif.

[73] Assignee: Uneco Engineering, Inc., Bakersfield, Calif.

[21] Appl. No.: 102,052

[22] Filed: Aug. 4, 1993

[51] Int. Cl.[6] ..... B67D 5/00

[52] U.S. Cl. ..... 222/83.5; 222/81; 141/330

[58] Field of Search ..... 222/1, 80, 81, 83, 83.5, 222/88; 141/329, 330

[56] References Cited

U.S. PATENT DOCUMENTS

| | | | |
|---|---|---|---|
| 3,288,178 | 11/1966 | Johnson | 141/330 |
| 3,538,866 | 11/1970 | Gaines | 222/83.5 X |
| 3,828,973 | 8/1974 | Birrell | 222/1 |
| 4,040,389 | 8/1977 | Walters | 222/81 |
| 4,049,157 | 9/1977 | Carson | 222/81 |
| 4,332,334 | 6/1982 | Mian | 222/83.5 |
| 4,527,716 | 7/1985 | Haas et al. | 222/83.5 |
| 4,557,825 | 12/1985 | Wittes et al. | 209/3 |
| 4,597,423 | 7/1986 | Chenot | 141/330 |
| 4,846,236 | 7/1989 | Deruntz | 222/81 |
| 4,871,359 | 10/1989 | Sjonell | 222/81 X |
| 5,080,259 | 1/1992 | Hadley | 222/83.5 |
| 5,111,910 | 5/1992 | Sheppard, Jr. | 184/1.5 |

FOREIGN PATENT DOCUMENTS

| | | | |
|---|---|---|---|
| 2824601 | 12/1979 | Germany | 222/81 |
| 2026992 | 2/1980 | United Kingdom | 141/330 |
| 1377244 | 2/1988 | U.S.S.R. | 222/83 |

*Primary Examiner*—Andres Kashnikow
*Assistant Examiner*—Joseph A. Kaufman
*Attorney, Agent, or Firm*—Knobbe, Martens, Olson & Bear

[57] ABSTRACT

A bag opener and dispenser device for emptying quantities of dry pourable material from bags which are hoisted above reactor vessels. The device has a funnel-shaped side wall with a lower annular surface adapted to be mounted to a manway opening leading to the reactor vessel. An apparatus centered within the funnel has an upwardly pointing hollow tip for piercing the bag. The device further includes a horizontal dust containment plate on which the bag is supported. The bag is lowered over the tip which cuts a flap in the bottom of the bag for pourable material to fall through the tip and also through a surrounding region covered with a mesh. In order to facilitate egress of the pourable material from the bag, elongated holes are formed in the side wall of the hollow tip. The dust containment plate sealingly mates with the sides of the bag to prevent the formation of dust.

16 Claims, 4 Drawing Sheets

BULK BAG OPENER AND DISPENSER

FIELD OF THE INVENTION

The present invention relates to an apparatus for dispensing pourable materials from flexible bags and, more particularly, to an improved bag opener and dispenser adapted to attach to an opening on a container structure.

BACKGROUND OF THE INVENTION

Numerous industries, such as oil and gas production and refining, chemical, food processing and water treatment industries, utilize dry, dusty materials which are packaged in bags. The bags may be made of paper, plastic or fabric, and typically weigh one ton, or more. Many applications for such bags require the bag to be lifted to a great height to be dispensed into an opening at the top of a container. For example, the use of bags of a consumable material to clean up various natural gases in $H_2S$ reactors is known. Such reactor vessels typically have an upwardly extending column terminating in a manway into which the consumable material is added.

In order to put the contents of the bag into such reactor vessels, the bag is hoisted by a crane above the open manway on top of the reactor vessel column—sometimes as much as 40–50 feet above ground level. Two workers on a walkway, one to hold the bag steady and one to pull a release string and retrieve a plastic spout, empty the bag into the manway while it is being held in place by the crane. The plastic spout is typically very short—12–22 inches—which requires that the bag must be held very close to the opening before the spout is released. The release of the spout above the manway produces dust. Moreover, should the crane falter or fail during the time a worker's arms are under the bag, serious injuries could result. For that reason, safety inspectors have curtailed this operation and have required that a better way of handling the bags during the dumping operation be found.

Several prior patents disclose apparatus and/or methods for breaking bags for emptying into a container. U.S. Pat. No. 4,332,334, issued to Mian, shows a relatively complex, dustless bag breaker having a square box-shaped container covered with a hinged lid. The bag breaker includes an annular flange with bolt holes for mounting to the receptor vessel. A rotatable blade-like cutter is provided within the container and rotates on a shaft which also turns one or more flappers for striking the bag to urge the material out. This assembly is quite bulky and detrimentally requires power, a motor and a drive train to operate.

In U.S. Pat. No. 4,527,716, issued to Haas, et al., an apparatus for dispensing material from a bag utilizing a discharge tube having a pointed end is shown. The tube includes a flange for ostensibly forming a seal around the hole created by the pointed end and the material then is dispensed from the bag through the tube. However, this apparatus is not dust-free, and the time required for fully emptying the bag through the tube is quite long. Furthermore, a certain amount of the consumable material remains around the pointed end of the tube at the bottom of the bag, prior to withdrawing the tube, and is thus wasted.

U.S. Pat. No. 4,557,825, issued to Wittes, et al., shows a bag breaking device which mounts to the top of a tank into which abrasive material is dispensed. The device includes two connected V-shaped bars with their apexes pointing up onto which the bag is dropped. A bolt extends through the bars at the apex to facilitate puncturing of the bag. A grate covering a hole in the vessel is mounted below the bars so that the bag will be torn open and the contents dispensed through the grate into the container. This design does not provide for positioning of the bag over the bag breaking device, which can be a difficult operation for heavy bags hoisted with a crane high above a vessel. Additionally, due to the settling of abrasive material around the hole, it is likely that some remains in the bag and does not enter the vessel. The remaining material will then be lost when the bag is lifted off the tank, undesirably producing dust in the process.

Prior arrangements for emptying bags of material into vessels share another disadvantage in that the time required to locate the bag over the vessel opening and dispense the material is excessive and thus costly. Specifically, a crane is commonly used to hoist the bag over the vessel, the crane being rented or leased. The present bags having a drawstring and integral plastic spout must be precisely located over the vessel opening by the crane operator and then the drawstring released and spout unfurled by a worker on the vessel to dispense the material. The entire operation may take three to five minutes to empty the bag, which is costly when a large number of bags are being emptied into the vessel at once. In some instances, fifty bags may be emptied at once resulting in a total crane rental time of more than four hours.

With these and other disadvantages of the prior art in mind, the present invention discloses a novel bag opener and dispenser for mounting onto container openings located at heights requiring a crane to lift the bag.

SUMMARY OF THE INVENTION

The present invention provides an apparatus for opening bags filled with pourable material and transferring the material into a mouth of a vessel. The apparatus generally includes a body having an open top and a bottom, the body defining an inclined interior surface. The apparatus further includes a piercing element which is mounted within the body such that a bag filled with pourable material which is lowered through the open top toward the piercing element will be guided by the interior surface of the body towards the piercing element so that the force of gravity will impale the bag on the piercing element, releasing the material from the bag. An annular sealing plate is positioned around the piercing element and relative to interior surface of the body such that the plate supports the bag and the plate and the interior surface of the body form at least a partial seal therewith limiting the release of dust out of the open top of the apparatus. In addition, the apparatus defines an opening through which the pourable material falls into the mouth of the vessel, and an annular surface around the opening capable of forming a seal with a mating surface on the vessel to prevent leakage therebetween.

Preferably, the piercing element is hollow and defines an interior channel, and the annular sealing flange and the piercing element are sized such that an annular space is formed therebetween so that pourable material may fall through the channel or annular space. A grate may extend between the sealing flange and piercing element across the annular space. In accordance with one aspect of the present invention, a downwardly depending neck having an outer diameter smaller than the outer diameter of the bottom end of the body may be attached thereto so as to be insertable into the mouth of the vessel. Preferably, the outer diameter of the neck is only slightly smaller than the mouth to facilitate alignment of the apparatus within the mouth.

In another aspect of the present invention, there is provided an apparatus for opening a bag filled with pourable material and transferring said material into a mouth connected to a vessel, including a body, a piercing element and an annular sealing flange. The body includes an open top and a bottom and defines an interior surface. The piercing element is fixed with respect to and is at least partially secured within the body. The piercing element and the interior surface are shaped and positioned relative to one another such that the interior surface will guide a bag filled with a material lowered through said open top toward the piercing element to enable the force of gravity to impale the bag on the piercing element releasing the material. The piercing element advantageously includes an apex positioned below the top of the body to pierce the bag when the bag is below the top of the interior surface thereby substantially preventing spillage from the bag outside of the body as it is impaled on the piercing element. The annular sealing flange is positioned around the piercing element and is positioned relative the interior surface such that a bag impaled on the piercing element forms at least a partial seal with the sealing flange and the interior surface, thereby limiting the release of dust from the open top of the body. The apparatus defines an opening through which the material may fall into the mouth and additionally defines an annular surface capable of forming a seal with a mating surface connected to the vessel and surrounding the mouth to prevent the leakage of material between the surfaces.

In another aspect to the present invention, there is provided an improved bag opener and dispenser configured to mount to a manway opening high above a reactor vessel. The improved bag opener and dispenser generally comprises a funnel-shaped outer body, a piercing assembly mounted concentrically within the body and a lower peripheral surface for supporting the device over the manway. The funnel-shaped body is wide enough at the top end to receive bags of pourable material, typically hoisted by a crane using slings attached to the bag handles and deposited within the open end. The piercing apparatus includes an upwardly pointing hollow tip mounted centrally within the body and supported by a number of spars rigidly attached to the body. Below the tip, a dust containment plate extends across the body and has a central bore surrounding the tip through which pourable material may pass. Directly below the dust containment plate, a large mesh grate is provided to prevent the bag from getting stuck in the bag opener. A lower neck sized slightly smaller than the diameter of the manway may be provided to assist in aligning the bag opener over the manway.

According to one aspect of the present invention, the hollow tip forms the top end of a delivery pipe and comprises a cylindrical vertical wall portion and an upper angled rim. The rim defines a sharp angle from an apex on one side of the pipe to a lower position on the opposite side. The angled rim is beveled to form a cutting edge, which facilitates the opening of a hole in the bottom of the bag. The tip is positioned in relation to the dust containment plate so that a circular flap is formed in the bottom of the bag which will stay connected to the bag and not fall into the reactor vessel along with the pourable material. In this respect, the cutting edge begins at the sharp point and transitions at the lower position into the integrally depending pipe. The cutting edge loses effectiveness at the intersection with the dust containment plate so that the final piece of the flap in the bag is left attached.

The preferred hollow tip additionally includes one or more elongated slots in the vertical wall to facilitate the egress of pourable material from the bag. The pourable material may thus pass through the hollow tip and directly down through the delivery pipe. The slots reduce the amount of pourable material left within the bag.

In a further aspect of the present invention, the bag opener and dispenser is substantially dust-free in use. The bag is lowered onto the piercing tip and thereafter comes into contact with the dust containment plate to form a seal around the central hole. Additionally, the bag spreads out to a certain degree into contact with the outer funnel-like body. The end result is that dust is prevented from escaping from the piercing area.

In a preferred method of use of the present invention, a bag containing pourable material is hoisted to a predetermined height and lowered into proximity of the bag opener. A single worker guides the heavy bag the last few feet over the wide opening of the funnel-like body. The crane operator then lowers the bag into the bag opener. The hollow tip forms the hole in the bottom of the bag so that the pourable material may then be dispensed into the reactor vessel manway. No further guidance or action is required by the worker on the manway.

DESCRIPTION OF THE PREFERRED EMBODIMENTS

Figure 1:
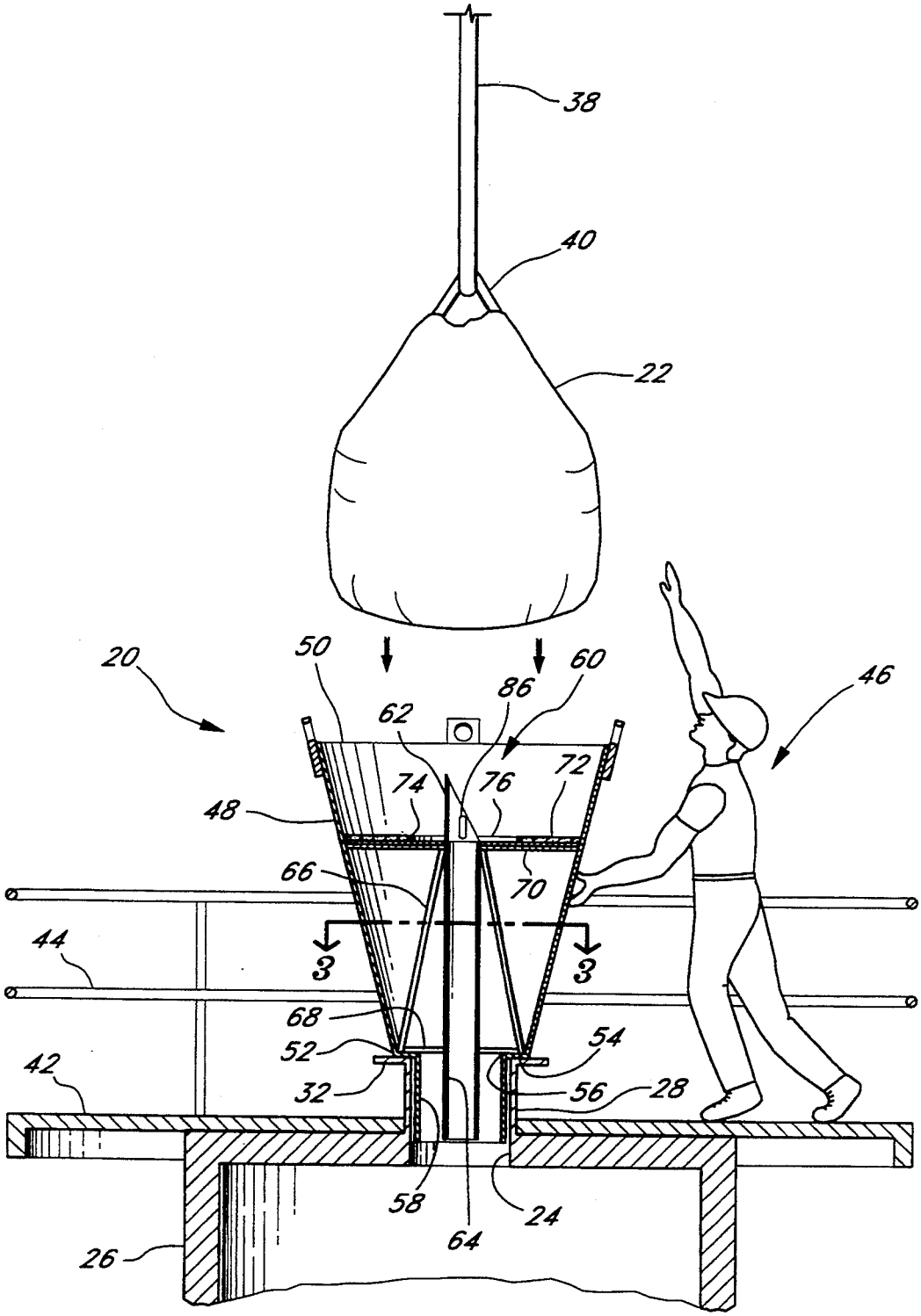
FIG. 1 is a schematic view of the bag opening and dispensing operation showing a preferred bag opener over a reactor vessel column in cross-section.

FIG. 1 shows schematically a bag opener 20 of the present invention being used to pierce and dispense the contents of a bag 22 into a manway opening or mouth 24 above a vertical column 26 leading to a vessel (not shown). Many such vessels having elongated vertical columns 26 terminating in a hatch or manway 28 are common in industrial applications, such as oil and gas production and refining, waste water treatment plants, etc. Often, the contents within the vessel require treatment to remove certain impurities or to separate useful components. One application of the present invention involves the addition of a large amount of consumable material to a gas stream to remove hydrogen sulfide ($H_2S$) and mercaptans. The material is available in small 50-pound bags; however, for large systems, bags up to 3,000 pounds are used.

The description herein may be considered to encompass the piercing and dispensing of a variety of types of consumable material from bags generally having lift handles, sometimes referred to as "supersacks". The larger of these bags require a crane to lift them. Other smaller bags capable of being lifted manually may indeed be used, such bags, however, not taking full advantage of the inventive aspects of the preferred bag opener 20. For the purposes of this description, large bags may be considered to be bags having a weight greater than 50 lbs when full, while extra large bags denote bags in excess of 500 lbs. The consumable material may take a number of forms such as powder, granular, liquid, or a mixture, the common property being the capacity for pouring the material through the bag opener 20 without solidification or undue clotting occurring.

Typically, a crane (not shown) elevates the bag 22 through the use of a sling 38 looped through handles 40 of the bag. At the upper portion of the column 26, a circular platform 42 with a railing 44 supports a worker, shown at 46, who, as the bag approaches the bag opener, assists a crane operator (not shown) in positioning of the bag 22 the last few feet. In one important advantage of the present invention, only a single worker 46 is needed to assist the crane operator in locating the bag 22 directly over the bag opener 20. Furthermore, as will be more fully described below, the crane operator has a much larger target to aim for than prior bag dispensing devices and thus accomplishes this task faster. Advantageously, the worker 46 need not reach underneath the bag 22 to pull a drawstring, as was the case with the prior art, thus reducing the time spent in opening the bag 22 greatly. In actual operational situations, the bag opener 20 has shaved between 30–60 seconds off of the positioning and opening process, conceivably reducing the time spent emptying 50 bags at once by nearly an hour.

Figure 2:
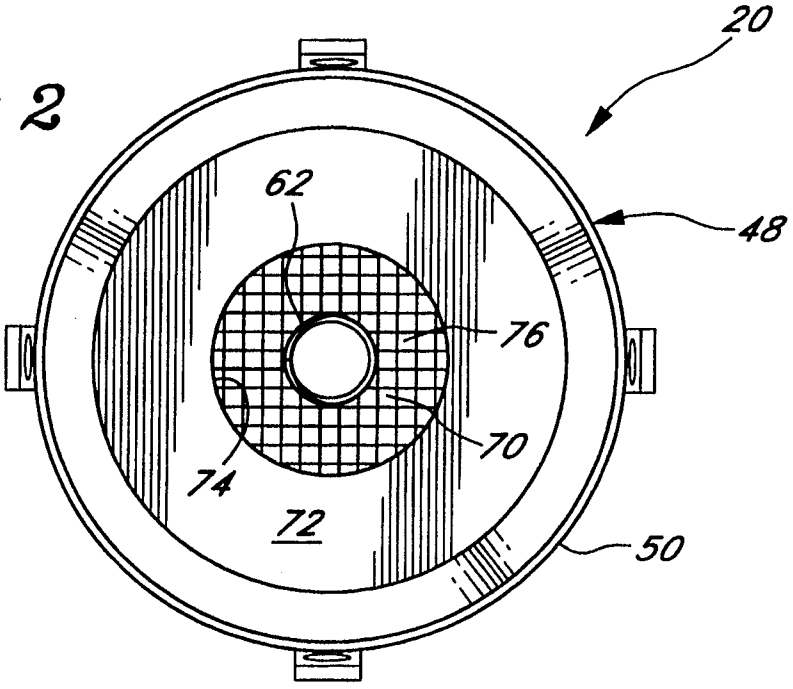
FIG. 2 is a top view of the bag opener of FIG. 1.

Now with reference to FIGS. 1 and 2, the components of the bag opener 20 of the present invention will be described. The bag opener 20 generally comprises a cone-shaped outer funnel or body 48 with a sloping diameter transition from a wide upper open end 50 to a smaller diameter bottom end 52. The body 48 includes an annular surface 54 adapted to rest on a mating surface or rim flange 32 of the manway mouth 24. Preferably, the annular surface 54 is formed by a shoulder which effects a diameter transition from the bottom end 52 to a lower opening 56. Alternatively, it is possible the annular surface 54 is formed by an outwardly extending flange, the lower opening 56 in that case having the diameter of the bottom end 56.

A generally constant diameter lower neck 58, coincident with the lower opening 56 of the body 48, projects downward into the manway 28 and terminates a predetermined distance below the annular surface 54. The neck 58 desirably maintains the relative position of the opener 20 and the mouth 24 and, preferably, extends a number of inches into the manway mouth 24 to maintain this relative position. Preferably, the neck 58 is sized between 1 and 2 inches smaller than the manway mouth 24. In an alternative configuration, the neck 58 may be provided larger than the manway mouth 24 so that the annular surface 54 is formed by the lower surface of an outwardly extending transition shoulder between the bottom end 52 and neck.

The bag opener 20 includes a bag piercing apparatus 60 therewithin for opening a hole in the bottom of the bag 22 so that pourable material falls into the manway mouth 24. The bag piercing apparatus 60 comprises a piercing element formed by a pointed hollow tip 62 at the upper end of an elongated delivery pipe 64, the piercing element being supported by a plurality of diagonal spars 66. The diagonal spars 66 connect the upper end of the pipe 64 to a location proximate the lower opening 56 of the body 48 and attach rigidly to the interior surface of the body at this location.

Figure 3:
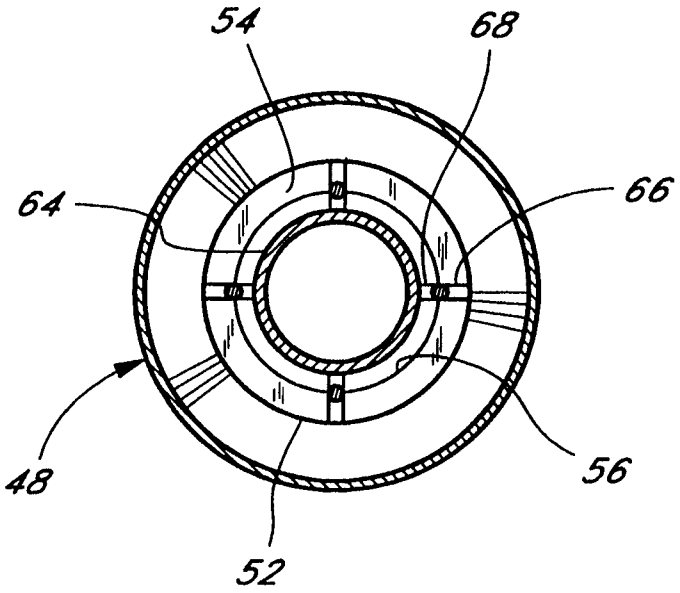
FIG. 3 is a cross-sectional view of the bag opener taken along line 3—3 of FIG. 1.

As seen partially in cross-section in FIG. 3, there are preferably four diagonal spars 66 spaced 90° around the delivery pipe 64. The attachment between the spars 66, pipe 64 and interior surface of the body 48 is preferably by welding or other conventional fastening means. In addition to the diagonal spars 66, four generally horizontal spars 68 span across the lower opening 56 from the body 48 to the pipe 64 and are rigidly attached thereto to provide further support for the pipe at its lower end.

As illustrated in FIG. 1, at the approximate intersection of the delivery pipe 64 and hollow tip 62, a large-mesh grate 70 extends from the inner wall of the body 48 to rigidly attach to the pipe. An annular dust containment plate 72 mounts above the grate 70 with the outer edges of the two elements preferably rigidly fastening to the interior surface of the body 48. The diagonal spars 66 mount directly to the grate 70 or provide support to the center region of the grate through their mutual attachment at the pipe. The grate 70 in turn provides support for the dust containment plate 72 as well as prevents the bag 22 from passing through the orifice 76 and possibly getting stuck. In this regard, the grate 70 desirably extends between the body 48 and tip 62 and provides lower support for the plate 72 although, in an alternative embodiment, the grate may be sized only large enough to cover the orifice 76 provided the plate is otherwise vertically supported in a manner not shown. The annular dust containment plate 72 includes a central bore 74 sized larger than the diameter of the delivery pipe 64, so that an annular space or orifice 76 covered only by the grate 70 is formed around the pipe.

The hollow tip 62 extends a sufficient distance above the grate 70 and plate 72 to define a sharp bag piercing unit. In this regard, the bag is dropped down through the upper open end 50 of the body 48 to come into contact with a sharp apex 78 of the tip 62. Further lowering of the bag 22 causes the hollow tip 62 to pierce the outer woven fabric of the bag and form a hole for pourable material to fall through. The impaled bag 22 then comes to rest on the annular dust containment plate 72, the bag typically settling outward to contact the interior surface of the body 48. The dust containment plate 72 thus comprises an annular sealing flange preventing fugitive dust from escaping between the plate and bag 22. Thereafter, the pourable material dispenses directly through the hollow tip 62 and delivery pipe 64 into the manway 28. In addition, material which escapes around the sides of the tip 62 falls through the grate 70 across the annular orifice 76.

The apex 78 is located below the top end 50 of the body 48 so that a hole may be opened in the bag 22 below the surrounding body. This is important to prevent fugitive particles from falling or being blown laterally out of the body 48 after the hole is initiated but before the bag 22 forms a seal with the dust containment plate 72.

Although described and illustrated herein as tubular, the hollow tip 62 may take any number of forms providing a sufficiently rigid and sharp structure to pierce a hole in the bag material. Moreover, although it is desirable that the tip 62 be hollow to facilitate egress of the pourable material from the bag in a straight vertical downward path, the inclusion of the orifice 76 surrounding the tip provides a secondary path which could become a primary path if the tip were solidly formed.

In another advantageous feature of the present invention, the inwardly sloping wall of the body 48 facilitates the positioning of the bag over the hollow tip 62. A single worker 46 need only generally locate the bag over the large upper open end 50, the bag then being centered by contact with the sloping wall. Presently, bags designed for applications such as described herein as preferred include drawstrings and integral spouts requiring a worker to reach under the bag and release the pourable material. Advantageously, the bag piercing apparatus 60 renders the integral spout unnecessary. Moreover, widespread use of the present invention will allow the bag manufacturer to eliminate the spout and drawstring arrangement and instead supply a smooth-bottomed bag, thus reducing the cost.

Figure 4:
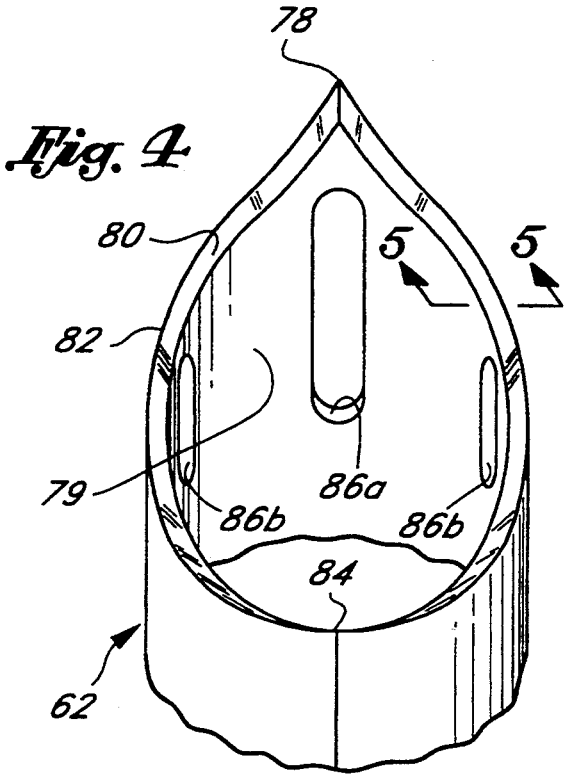
FIG. 4 is perspective view of a preferred hollow piercing tip of the bag opener.
Figure 5:
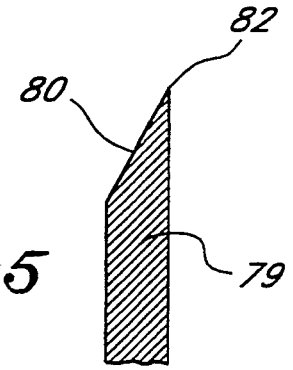
FIG. 5 is a cross-sectional view along a cutting edge of the piercing tip taken along line 5—5 of FIG. 4.
Figure 6:
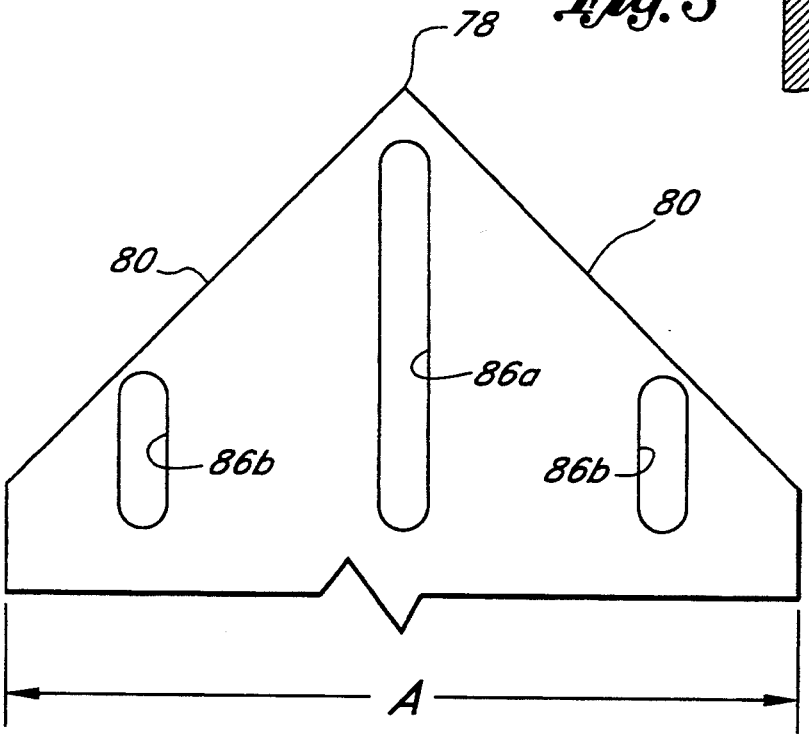
FIG. 6 is a developmental view of the piercing tip of FIG. 4.

Now referring to FIGS. 4 and 5, and the developmental, or unrolled, view of FIG. 6, the preferred construction of the hollow tip 62 will be described. A vertical wall 79 of the tip 62 has a tapered upper rim 80. The rim 80, which is arcuate due to the cylindrical wall 79, diverges downward and outward from the apex 78 to reconnect at a lower portion 84 on the opposite side from the apex. The rim 80 is beveled on one side, as shown best in the cross-section of FIG. 4. The beveled rim 82 is formed so that a cutting edge 82 is on the outside of the hollow tip 62. The tip 62 may be formed by cutting off the top of the pipe 64 at an angle and subsequently grinding a bevel in the rim 80. This arrangement greatly facilitates the clean opening of a generally circular hole in the bottom of the bag 22.

As the bag 22 lowers into contact with the tip 62, the huge point force concentrated at the apex 78 initiates a hole which then propagates around in a circle as the bag descends along the knife-like rim 80. At the very bottom of its descent, the bag 22 comes to rest on the dust containment plate 72 and a substantially round flap (not shown) has been created by the hollow tip 62. The flap is connected to the bag at a side which is proximate the lower portion 84 of the rim 80. This lower portion 84 will not completely sever the flap due to the fact that the bag 22 comes to rest at that location and no further shearing along the rim 80 occurs.

The delivery pipe 64 is of a sufficient diameter to allow the pourable material within the bag 22 to rapidly exit downward through the hollow tip 62 pushing the flap into the pipe. As shown in FIG. 6, the dimension A corresponds to the circumference of the pipe 64; as well as the integral tip 62. This dimension A may be varied depending on the type of material in the bag 22 and the application (i.e. preferred rate of flow).

In the preferred embodiment, the delivery pipe 64 and hollow tip 62 have a diameter of approximately 8 inches. The apex 78 may extend upward into the space within the body 48 above the dust containment plate 72 a distance of approximately 14 inches. Thus, the angled rim 80 forms an approximately 30° angle with the vertical. The beveled cutting edge 82 may be between 10 and 30 degrees, and is preferably approximately 30°.

In accordance with another important advantage of the present invention, passages or slots 86 may be provided in the side wall 79 of the hollow tip 62. The slots 86 facilitate egress of the pourable material from the bag 22. In this regard, the pourable material may fall into the tip 62 through the slots 86, thereafter falling through the delivery pipe 64. In the preferred embodiment, there are three slots 86; a large slot **86*a* extending proximate the apex 78 vertically downward, and two smaller slots 86 spaced circumferentially around the tip wall 79 from the large slot. Preferably, the small slots 86*b* are spaced 90° around the tip 62 from the large slot 86*a*. Desirably, the narrow dimension of the slots 86** are at least 1½ inches wide to accommodate the preferred pourable material, although this dimension is variable.

The present bag opener 20 is adapted for use on any number of manway mouths 24, the diameter of the neck 58 being variable. In this regard, the lower neck 58 may be custom fit to have a slightly smaller diameter than the diameter of the particular manway mouth 24. It is contemplated that the annular surface 54 will be manufactured as one or more universal sizes which may fit a variety of manway mouths 24. For example, the neck 58 may be sized several inches smaller than the annular surface 54, the bag opener 20 thus capable of resting on a manway mouth 24 having a diameter between these two sizes.

In the embodiment shown in FIG. 1, the overall height from the bottom of the lower neck 58 to the upper open end 50 is approximately 65 inches. This height includes a distance of 18 inches between the upper open end 50 and the dust containment plate 72, and a 15 inch long lower neck 58, leaving 32 inches between the grate 70 and annular surface 54. The upper open end 50 in this embodiment is approximately 50 inches in diameter, with the intermediate body diameter at the location of the dust containment plate 72 approximately 43 inches. The bag opener 20 thus accommodates bags 22 having a width dimension of up to approximately 36 inches. As the bag 22 is impaled on the hollow tip 62, and comes to rest on the dust containment plate 72, it will ideally spread outward to this intermediate diameter.

It is presently contemplated that the bag opener 20 may be manufactured to a shorter overall dimension to reduce the amount of steel required. A shorter opener 20 also makes positioning the bag 22 over the upper open end 50 a simpler process for the worker 46. Reducing the overall height of the bag opener 20 will undoubtedly require a wider body 48 angle, but the dimensions of the upper open end 50 and lower opening 56 will preferably remain approximately the same. In general, the dimensions of the bag opener 20 above the grate 70 remain consistent while the distance between the grate and lower opening 56 are variable, and in fact may be reduced to zero.

As shown in the present illustrations, the conical wall of the body 48 has an outwardly tapering open top end 50, the taper desirably forming an included angle of between 20°–90°, and preferably between 20°–45°, and more preferably approximately 22°. Specifically, the conical wall of the body 48 may form an upwardly opening included angle of greater than 22° in order to reduce the overall height of the bag opener 20 or for other considerations.

Figure 7:
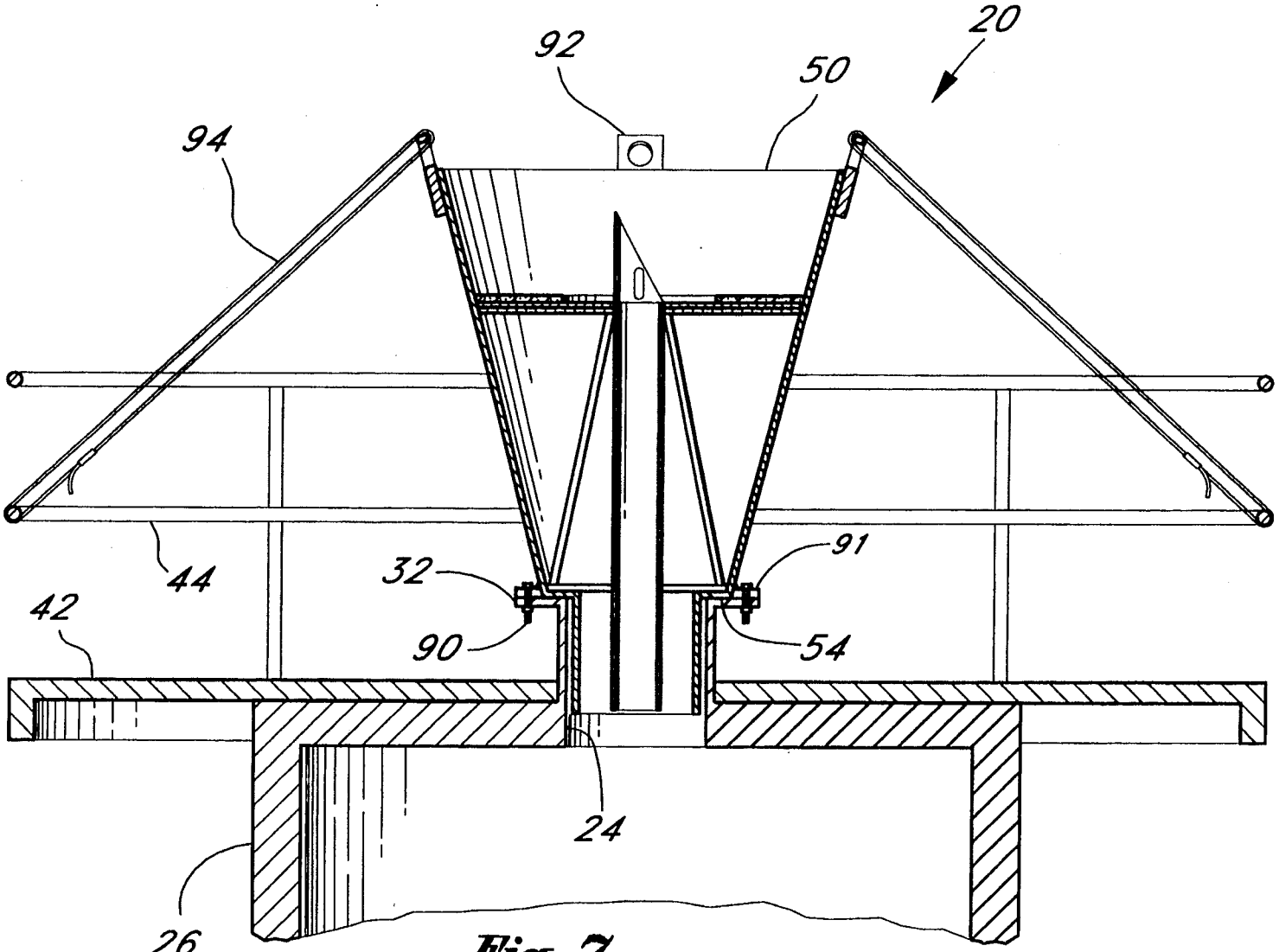
FIG. 7 is an elevational view of the bag opener having optional lateral securing means.

A customer of the bag opener 20 may choose to simply position the opener over a manway 28 or, in order to add lateral support, may rigidly attach or otherwise tie the opener in place. As seen in FIG. 7, the bag opener 20 may include an outwardly extending flange 91 having through-holes for a plurality of bolts 90 and sized and located to correspond to bolt holes in the manway flange 32. The flange 91 is typically welded to the outer surface of the body 48 at the elevation of the annular surface 54, thus enlarging the annular surface. A bolt hole pattern corresponding to the pattern on the particular manway mouth 24 may be provided after a customer has provided manway specifications. Other rigid fastening means are contemplated, such as clips, magnets, etc. These alternative fasteners providing a more adaptable attachment means, thus eliminating the need to "customize" a bolt hole pattern, although openers having common hole patterns may be stocked as off-the-shelf items.

As is also shown in FIG. 7, the bag opener 20 may be tied or strapped to the platform 42 or railing 44. Preferably, the upper open end 50 of the body 48 includes a plurality of strap grommets 92 for attaching stabilizing straps 94 extending to the railing 44. There are preferably four such grommet 92 and strap 94 assemblies, but may be as few as two. The stabilizing straps 94 may be nylon, chain, rope or other suitably strong material. The attachment of these straps 94 provides a level of lateral support to the opener 20 to prevent tipping in high winds or if inadvertently struck by the dangling bag 22.

In operation, a crane operator attaches the crane hook to the sling 38 passing through the handles 40 of a full bag 22. The bag 22 is then hoisted to an elevation typically between 15 and 50 feet above the manway 28 of the reactor column 26. The bag opener 20 of the present invention has previously been positioned over the manway mouth 24, and may have been secured with the aforementioned bolts 90 or straps 94, or both for additional security. The worker 46 standing on the platform 42 assists the crane operator in positioning the heavy bag 22 directly over the wide upper open end 50 of the bag opener. At a signal from the worker 46, the crane operator lowers the bag 22 into the body 48 while the worker stands back.

The bag 22 may be guided by the sloping walls of the body 48 directly over the hollow tip 62. The extremely sharp apex 78 initiates a hole through the bag material as the bag descends further. A generally circular hole forms as the bag descends from shearing contact with the sharp cutting edge 82 of the tip 62. The shearing action stops prior to forming a complete circular cutout in the bag 22 as the bag 22 finally comes to rest on the dust containment plate 72. The bag 22 may also settle outward to contact the body 48. Pourable material flows out of the hole in the bag through the hollow tip 62 and depending delivery pipe 64 into the manway 28 and thereafter, into the reactor column 26 to eventually reach the reactor vessel. Some pourable material may flow inward through the slots 86 into the hollow tip 62 to drop through the pipe 64. Advantageously, the slots 86 reduce the amount of material remaining at the bottom of the emptied bag around the tip 62.

After a suitable period, the bag 22 has emptied and the worker 46 signals the crane operator to remove it from the bag opener 20. The slings 38 are disengaged from the crane hook once the bag is on the ground freeing up the crane to pick up a second prepared bag nearby.

Although this invention has been described in terms of certain preferred embodiments, other embodiments that are apparent to those of ordinary skill in the art are also within the range of this invention. Accordingly, the scope of the invention is intended to be defined only by reference to the following claims.

What is claimed is:

1. An apparatus for opening a bag filled with a pourable material and transferring said material into a mouth connected to a vessel, comprising:

a body having an open top and a bottom, said body defining an inclined interior surface;

a piercing element having an apex fixed with respect to and at least partially secured within said body, said piercing element and said interior surface shaped and positioned relative one another such that said interior surface will guide a large bag filled with a material lowered through said open top toward said piercing element to enable the force of gravity to impale said bag on said piercing element releasing said material;

an annular sealing plate positioned around said piercing element below said apex and positioned relative said interior surface such that when said bag is impaled on said piercing element said bag is supported by said plate and forms at least a partial seal with said sealing plate and said interior surface, thereby limiting the release of dust from said open top, said apparatus defining an opening through which said material from said bag impales on said piercing element falls into said mouth, said apparatus further defining an annular surface capable of forming a seal with a mating surface connected to said vessel and surrounding said mouth to prevent the leakage said material between said surfaces, wherein said annular sealing plate and said piercing element are sized and shaped such that an annular space is formed between said sealing plate and said piercing element and said annular space defines at least a portion of said opening, said apparatus further comprising a grate extending between said sealing plate and said piercing element within said annular space preventing a bag from passing through said annular space.

2. The apparatus of claim 1, wherein said piercing element defines an interior channel which defines at least a portion of said opening.

3. The apparatus of claim 2, wherein said piercing element includes at least one aperture providing communication between an external surface of the piercing element and said interior channel of the piercing element facilitating the egress of pourable material from said bag.

4. The apparatus of claim 1, wherein said piercing element includes an elongate cylindrical pipe extending beyond said bottom of said body to aid the flow of said material into a mouth connected to a vessel.

5. The apparatus of claim 4, wherein said mating surface supports the weight of said apparatus.

6. The apparatus of claim 5, further comprising a neck having an outer diameter smaller than said outer diameter of said bottom of said body, said neck sized and shaped to be insertable into a mouth connected to a vessel.

7. The apparatus of claim 6, wherein said outer diameter of said neck is only slightly smaller that an inner diameter of a mouth connected to a vessel so that the insertion of said neck within said mouth facilitates the alignment of said apparatus with said mouth.

8. The apparatus of claim 1, wherein said piercing element includes the apex positioned below said top of said body to pierce said bag when said bag is below the top of said interior surface thereby substantially preventing spillage from said bag outside of said body as it is impaled on said piercing element.

9. An apparatus for opening a bag filled with a pourable material and transferring said material into a mouth connected to a vessel, comprising:

a body having an open top and a bottom, said body defining an inclined interior surface;

a piercing element fixed with respect to an at least partially secured within said body, said piercing element and said interior surface shaped and positioned relative one another such that said interior surface will guide a large bag filled with a material lowered through said open top toward said piercing element to enable the force of gravity to impale said bag on said piercing element releasing said material, said piercing element including an apex positioned below said top of said body to pierce said bag when said bag is below the top of said interior surface thereby substantially preventing spillage from said bag outside of said body as it is impaled on said piercing element;

an annular sealing flange positioned around said piercing element below said apex and positioned relative said interior surface such that when said bag is impaled on said piercing element said bag forms at least a partial seal with said sealing flange and said interior surface, therby limiting the release of dust from said open top, said apparatus defining an opening through which said material from said bag impaled on said piercing element falls into said mouth, wherein said piercing element defines an interior channel which defines at least a portion of said opening, said apparatus further defining an annular surface capable of forming a seal with a mating surface connected to said vessel and surrounding said mouth to prevent the leakage of said material between said surfaces, wherein said annular sealing flange and said piercing element are sized and shaped such that an annular space is formed between said sealing flange and said piercing element and said annular space defines at least a portion of said opening.

10. The apparatus of claim 9, wherein said piercing element includes at least one aperture providing communication between an external surface of the piercing element and the interior channel of the piercing element facilitating the egress of pourable material from said bag.

11. The apparatus of claim 9, wherein said piercing element includes an elongate cylindrical pipe extending beyond said bottom of said body to aid the flow said material into a mouth connected to a vessel.

12. The apparatus of claim 9, wherein said mating surface supports the weight of said apparatus.

13. The apparatus of claim 12, further comprising a neck having an outer diameter smaller than said outer diameter of said bottom of said body, said neck sized and shaped to be insertable into a mouth connected to a vessel.

14. The apparatus of claim 13, wherein said outer diameter of said neck is only slightly smaller than an inner diameter of a mouth connected to a vessel so that the insertion of said neck within said mouth facilitates the alignment of said apparatus with said mouth.

15. The apparatus of claim 12, further comprising means for fastening said body to said vessel to help prevent relative lateral movement therebetween.

16. An apparatus for opening a bag filled with a pourable material and transferring said material into a mouth connected to a vessel, comprising:

a body having an open top and a bottom, said body defining an inclined interior surface;

a piercing element fixed with respect to and at least partially secured within said body, said piercing element and said interior surface shaped and positioned relative one another such that said interior surface will guide a large bag filled with a material lowered through said open top toward said piercing element to enable the force of gravity to impale said bag on said piercing element releasing said material, said piercing element including an apex positioned below said top of said body to pierce said bag when said bag is below the top of said interior surface thereby substantially preventing spillage from said bag outside of said body as it is impaled on said piercing element, said piercing element further comprising a lower portion;

an annular sealing flange positioned around said piercing element below said apex and positioned relative said interior surface such that when said bag is impaled on said piercing element said bag forms at least a partial seal with said sealing flange and said interior surface, thereby limiting the release of dust from said open top, said annular sealing flange defining a plane, said apparatus defining an opening through which said material from said bag impaled on said piercing element falls, said apparatus defining an opening through which said material falls into said mouth, wherein said piercing element defines an interior channel which defines at least a portion of said opening, said apparatus further defining an annular surface capable of forming a seal with a mating surface connected to said vessel and surrounding said mouth to prevent the leakage of said material between said surfaces, wherein said annular sealing flange and said piercing element are sized and shaped such that an annular space is formed between said sealing flange and said piercing element and said annular space defines at least a portion of said opening, said lower portion of said piercing element generally intersecting said plane of said annular sealing flange.

* * * * *